US006622355B2

(12) United States Patent
Buscart et al.

(10) Patent No.: US 6,622,355 B2
(45) Date of Patent: Sep. 23, 2003

(54) MOUNTING STRUCTURE

(75) Inventors: Jordi Badrenas Buscart, Barcelona (ES); John S. Pontaoe, Chicago, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/310,270

(22) Filed: Dec. 5, 2002

(65) Prior Publication Data

US 2003/0121130 A1 Jul. 3, 2003

Related U.S. Application Data

(60) Provisional application No. 60/345,693, filed on Jan. 3, 2002.

(51) Int. Cl.[7] ..... A44B 21/00
(52) U.S. Cl. ..... 24/615; 24/271; 24/272
(58) Field of Search ..... 24/614, 615, 272, 24/271, 311, 265 EC, 265 BC

(56) References Cited

U.S. PATENT DOCUMENTS 4,202,087 A * 5/1980 Wilderman ..... 166/243
5,546,637 A * 8/1996 Niedecker ..... 24/30.5 R
6,126,122 A * 10/2000 Ismert ..... 248/74.1
6,446,915 B1 * 9/2002 Ismert ..... 248/68.1
6,463,631 B2 * 10/2002 Noda ..... 24/16 R

* cited by examiner

*Primary Examiner*—Robert J. Sandy
(74) *Attorney, Agent, or Firm*—Mark W. Croll; Paul F. Donovan

(57) ABSTRACT

A mounting structure for buckles, cord locks and the like is provided with a base and a body for placement on opposite sides of the article to which the component is to be secured. A first connector part in the nature of a rack is provided on one of the body and base, and a lug is provided on the other of the body and the base for engagement at various locations along the rack to secure the body and base on opposite sides of the article.

26 Claims, 3 Drawing Sheets

MOUNTING STRUCTURE

CROSS-REFERENCE TO RELATED APPLICATION

This application claims benefit to U.S. provisional application Ser. No. 60/345,693, filed on Jan. 3, 2002.

FIELD OF THE INVENTION

The present invention relates generally to mounting structures, and more particularly to mounting structures having utility in applications such as, for example, buckles and cord locks used on clothing, sporting gear, luggage, safety equipment and the like.

BACKGROUND OF THE INVENTION

A wide variety of buckles, cord locks and other assemblies are known, with applications thereof in many different constructions, including, for example, clothing, sporting gear, luggage, safety and other equipment and the like. Two-part buckle assemblies are known in a variety of different constructions. In a two-part buckle, cooperating first and second buckle pieces are provided with parts having interlocking components, allowing releasable locking engagement of the components. Cord locks are known for securing cords used in openings of bags, as cinctures on waistbands and cuffs, as draw strings for hoods, as well as numerous other applications.

For a two-part buckle, it is known to provide a female buckle component attached to one part of an article, and a male buckle component attached to another part of the article. For example, the female component may be anchored to a bag or luggage, and the male component attached directly to a lid, cover or flap of the bag or luggage. Alternatively, one or both of the components may be attached to a strap or the like. It is known also to provide the male and female components on opposite ends of a strap or belt, or on separate straps of articles to be connected together. Similarly, a cord lock may be carried directly on the cord or may be anchored directly to the article or to a strap, lanyard or the like that is attached to the article.

Attachment of the various components for cord locks, buckles and the like to the article on which they are used has been accomplished by a variety of different means, including sewing, gluing, physical attachment and the like. One of the problems associated therewith is that the attachment technique can be complicated and time consuming, thus adding to the time and expense of manufacture. Another problem can occur if the component, which often is made of plastic, breaks or otherwise becomes non-functional. Removal of the broken component can be difficult, and attachment of a replacement component can be time consuming. Buckles designed for one application may not be useful readily on another article for another application, particularly if the various articles are of different thickness. Thus, it is necessary to manufacture and store many different components suitable for anchoring on different articles.

Thus, there is a need in the art for an anchoring structure that can be used in a variety of articles of different thickness, that attaches quickly and easily and that can be replaced when needed, yet is secure in its attachment.

SUMMARY OF THE INVENTION

The present invention provides an anchoring or mounting structure that is useful for buckles, cord locks and the like, that includes first and second parts disposed on opposite sides of the article to which it is secured. Legs from one of the parts extend through the article and are connected to the other part by a variable attachment structure accommodating different article thickness.

The present invention provides, in one form thereof, an adjustable attachment structure with a body and a base. One of the body and the base has a plurality of legs projecting outwardly therefrom. The other of the body and the base has receivers for accepting at least a portion of each leg. A first connector part is associated with the plurality of legs. A second connector part is associated with the receivers. The first and second connector parts are adapted for cooperative association to connect to each other and fix a spaced relation between the body and the base at a plurality of locations, establishing different distances between the body and the base.

In another form thereof, the present invention provides an attachment structure with a body and a base. One of the body and the base has a plurality of slots therein, each slot having an entrance on a same side of the base. Each slot defines a rack angling inwardly in the base from the entrance. The other of the body and the base has legs extending outwardly therefrom. Each leg has a distal end and a foot at the distal end. Each foot is designed to slide in one of the slots, with the legs configured to engage the racks at discrete locations along the lengths thereof.

In still another form thereof, the invention provides an attachment structure with a body and a base discrete from the body. One of the body and the base has a plurality of legs extending outwardly therefrom. The other of the body and the base has receivers each adapted and arranged for receiving one of the legs inserted therein. One of the legs and the receivers defines racks along lengths thereof, and the other of the legs and the receivers defines lugs for engaging the racks.

An advantage of the present invention is providing an attachment structure useful for mounting buckles, cord locks and other components on a variety of articles of differing thickness.

A further advantage of the present invention is providing a mounting structure that attaches to a variety of articles quickly and easily.

Yet another advantage of the present invention is providing a mounting structure for buckles, cord locks and the like that attaches securely, but can be readily detachable if the component requires replacement.

Other features and advantages of the invention will become apparent to those skilled in the art upon review of the following detailed description, claims and drawings, in which like numerals are used to designate like features.

Figure 1:
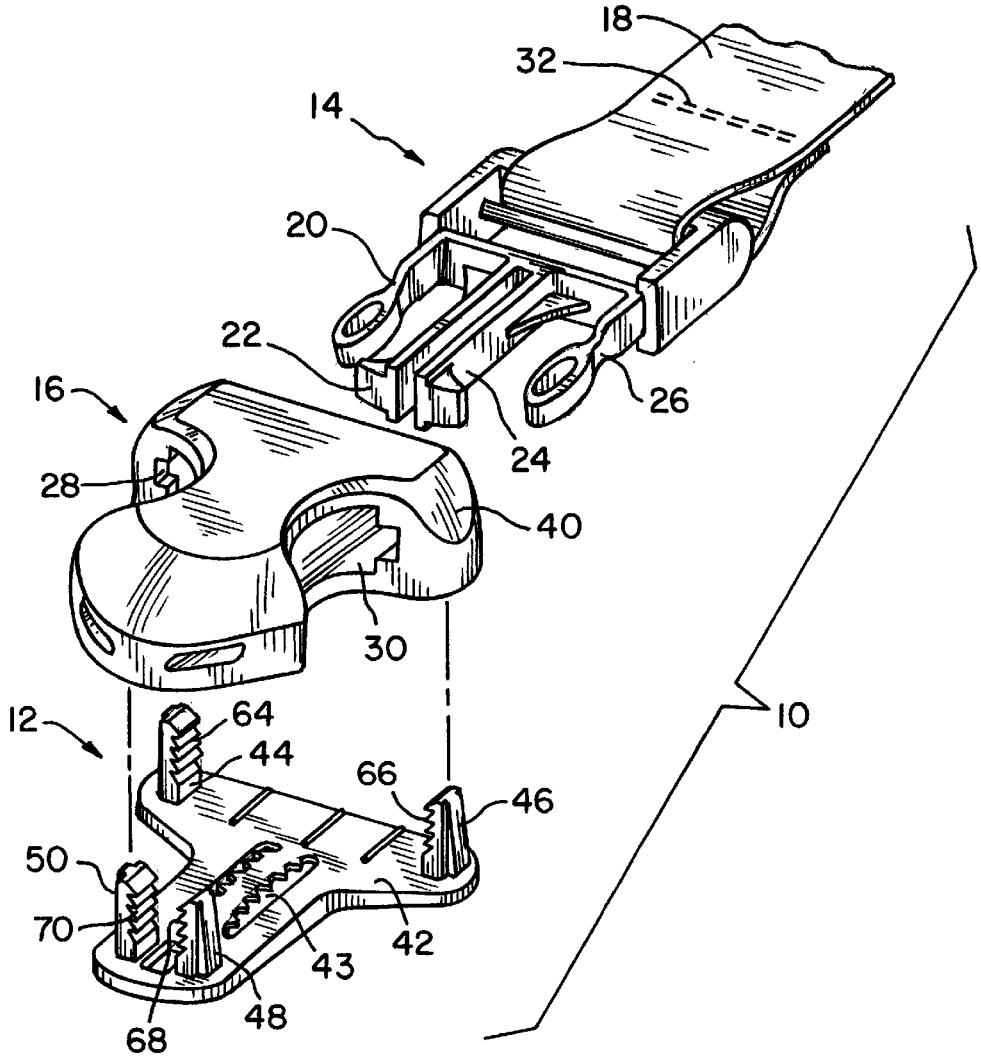
FIG. 1 is an exploded perspective view of a two-part buckle assembly having a mounting structure in accordance with the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including" and "comprising" and variations thereof is meant to encompass the items listed thereafter and equivalents thereof, as well as additional items and equivalents thereof.

DETAILED DESCRIPTION OF THE PREFERRED EMBODIMENT

Figure 2:
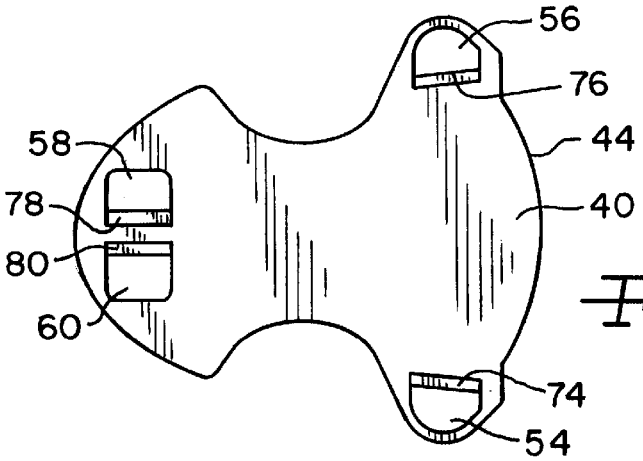
FIG. 2 is plan view of one of the mounting structure components shown in FIG. 1.

Referring now more specifically to the drawings, and to FIGS. 1 and 2 in particular, a two-part buckle assembly 10 is shown having an attachment structure 12 in accordance with the present invention. Buckle assembly 10 includes a male component 14 that can be received and releasably locked in a female component 16.

Buckle assembly 10 can be associated with a variety of different articles, such as luggage, clothing, safety equipment or the like. Male component 14 is attached to one article or part of an article and, as illustrated, is shown attached to a strap 18. Female component 16 is anchored to another article or part of an article (not shown in FIG. 1).

The manner in which male component 14 is releasably received in and connected to female component 16 is known to those skilled in the art and may take numerous different configurations. In the exemplary embodiment shown in FIG. 1, male component 14 includes forward projecting arms 20, 22, 24 and 26 that are received in an aperture or apertures in female component 16. Outer arms 20 and 26 deflect inwardly as male component 14 is inserted in female component 16, and spring outwardly to be exposed through windows 28 and 30 of female component 16, as male component 14 is fully inserted. Male component 14 is released from female component 16 by squeezing inwardly on outer arms 20 and 26 while urging male component 14 and female component 16 in opposite directions.

In accordance with the present invention, female component 16 includes attachment structure 12 for attaching female component 16 to an article (not shown in FIG. 1). While male component 14 is shown attached to strap 18 by a stitched seam 32, those skilled in the art will understand readily that connection of male component 14 to strap 18 or to another article (not shown) can be achieved also by employing the concepts and features of the present invention.

Female component 16 includes a body 40 and a base 42 that connect to each other. Body 40 defines windows 28 and 30 and generally the structure necessary for receiving male component 14. One of body 40 and base 42 includes a plurality of legs 44, 46, 48 and 50, and as illustrated in the embodiment shown, base 42 includes four legs 44, 46, 48 and 50. The other of body 40 and base 42 includes a receiver 54, 56, 58, 60 (FIG. 2) for each leg 44, 46, 48, 50, and in the embodiment illustrated body 40 includes four receivers 54, 56, 58 and 60. As shown, base 42 includes a connector portion 43, preferably a toothed member or toothed leaf spring that is adapted to cooperate with an article (not shown in FIG. 1). Although note clearly shown, prior to assembly, the leaf spring 43 can be slightly bowed inward with respect to the base 42. Upon assembly, the leaf spring can be pushed into a more horizontal position, thereby enhancing the ability of the teeth to grab or dig into the mating article. A feature of connector portion 43 is that it helps prevent dislocation or rotation of the entire structure 12 relative to the mating article (not shown in FIG. 1). In one embodiment, body 40 includes an insertion guide portion 44 (FIG. 2) that is preferably angled downwardly towards the base 42 when assembled to prevent wear of the mating article (not shown in FIG. 1) during repeated assembly of the male component 14. A first connector part in the nature of a rack 64, 66, 68, 70 is provided for each leg 44, 46, 48, 50. A second connector part in the nature of a lug or lip 74, 76, 78 and 80 is provided in each receiver 54, 56, 58 and 60, respectively. Legs 44, 46, 48, 50 are structured and arranged on base 42, projecting outwardly therefrom so as to be received in receivers 54, 56, 58 and 60 of body 40, with lugs 74, 76, 78 and 80 selectively engageable along the lengths of racks 64, 66, 68 and 70, respectively. Base 42 and the associated legs 44, 46, 48 and 50 are arranged and configured so as not to undesirably interfere with the insertion or release of the arms 20, 22, 24 and 26 of the male component 14. Upon complete assembly, the legs 44, 46, 48 and 50 are arranged and configured to be hidden or captured within the associated body 40 or base 42. Preferably, the legs would be hidden from view.

Attachment structure 12 can be modified in a variety of ways to accommodate components other than male component 14 or female component 16 or different configurations thereof. Further, attachment structure 12 is suited for modification to accommodate different articles on which it is to be attached.

Figure 3:
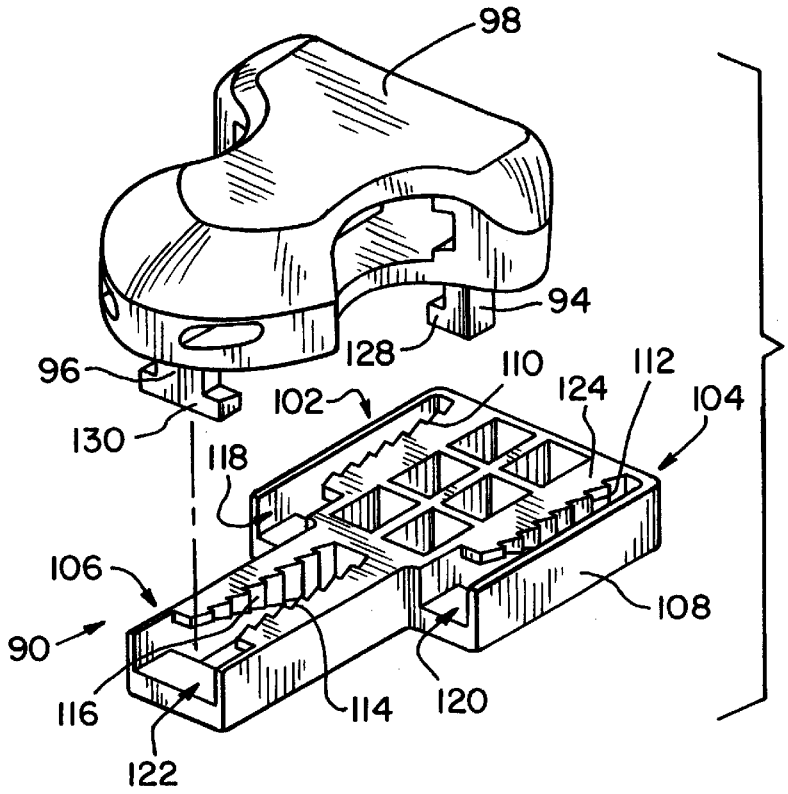
FIG. 3 is an exploded view of a buckle having a second embodiment of a mounting structure in accordance with the present invention.
Figure 4:
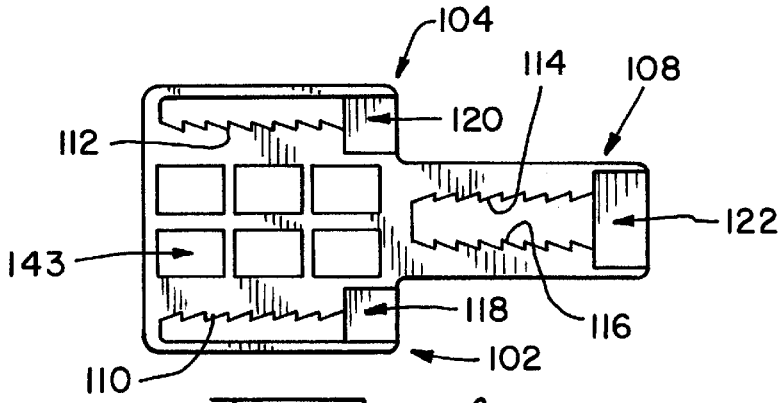
FIG. 4 is a plan view of the base in the mounting structure shown in FIG. 3.
Figure 5:
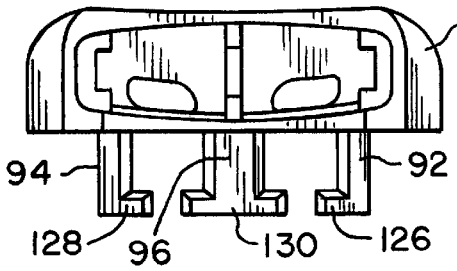
FIG. 5 is an elevational view of the body for the mounting structure shown in FIG. 4.

FIGS. 3–5 illustrate a second embodiment in the way of an attachment structure 90 wherein legs 92, 94 and 96 are provided on a body 98, and receivers 102, 104, 106 are provided on a base 108. Base 108 is a relatively flat, plate-like structure. Receivers 102, 104, 106 are formed as slots in base 108 and define racks 110, 112, 114 and 116 on side walls thereof. Slot-type receiver 106 is shown with two of racks 114 and 116 provided on opposite sides thereof. Alternatively, receiver 106 can be provided with only one rack 114 or 116, and/or receivers 102 or 104 can be provided with two racks on opposite sides thereof. Receivers 102, 104 and 106 have entrance openings 118, 120, 122, respectively, each provided in a same side 124 of base 108. Receivers 102, 104, 106, including racks 110, 112, 114 and 116 angle inwardly in base 108 from side 124.

Legs 92, 94, 96 each include a foot 126, 128, 130, respectively, on distal ends thereof, which enter receivers 102, 104 and 106 through entrance openings 118, 120 and 122, respectively, as body 98 is attached to base 108. Feet 126, 128 and 130 are wider than slot-type receivers 102, 104 and 106 inwardly from entrance openings 118, 120 and 122, such that body 98 and base 108 can not be pulled apart unless feet 126, 128 and 130 are positioned in entrance openings 118, 120 and 122. Legs 92, 94, 96 each define or function as a lug or lip, with edges thereof that engage along racks 110 and 112, 114, 116, respectively. With reference to FIG. 4, a plurality of openings 143 are shown which are simply provided to minimize material. However, it is envisioned that the base 108 can be modified to include the connector portion 43 as shown and described with reference to FIG. 1. It should be understood that other connector portions can be utilized in accordance with the principles of the present invention.

Figure 6:
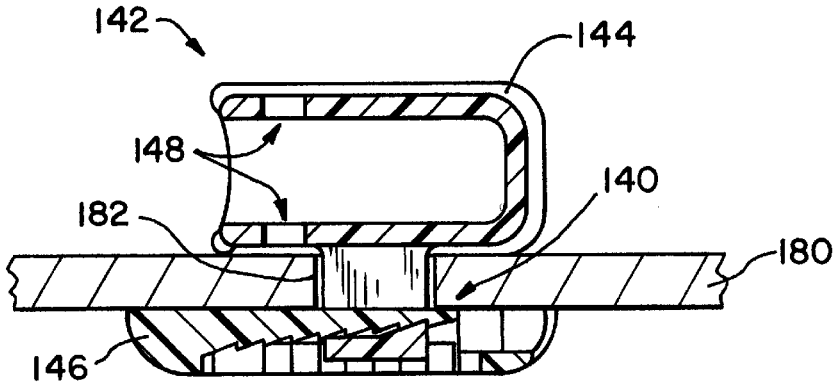
FIG. 6 is a cross sectional view of a cord lock having yet another embodiment for a mounting structure in accordance with the present invention.
Figure 7:
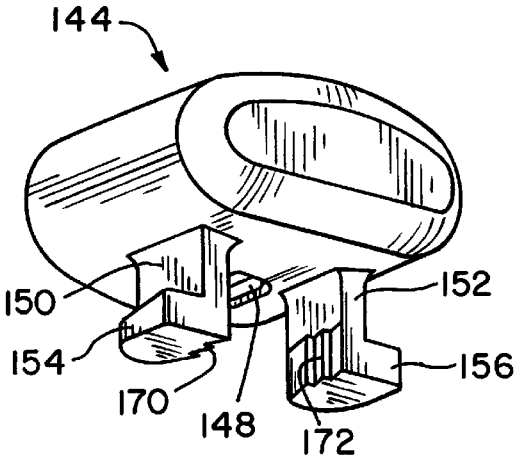
FIG. 7 is a perspective view of the cord lock body shown in FIG. 6.
Figure 8:
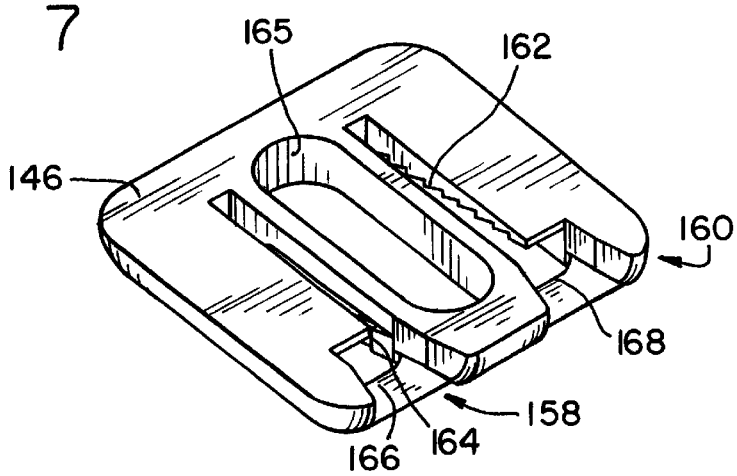
FIG. 8 is a perspective view of the base for the mounting structure shown in FIG. 6.

FIGS. 6, 7 and 8 illustrate a third embodiment in the way of an attachment structure 140 in accordance with the present invention. Attachment structure 140 is provided for a cord lock 142 having a body 144 and a base 146. Body 144 defines an aperture 148, and may include internal apparatus (not shown) for securing a cord (not shown) extended therethrough. Body 144 further includes legs 150 and 152, each having a foot 154, 156, respectively, on a distal end thereof. Slot-type receivers 158 and 160 are provided in base 146, and each defines a top rack 162 and a side rack 164 inwardly from respective entrance openings 166 and 168 thereof. Slot type receivers 158 and 160, and racks 162 and 164 defined thereby angle inwardly in base 146 from the surface thereof defining entrance openings 166 and 168. Lugs 170 and 172 on legs 150 and 152 engage side racks 164 in each receivers 158, 160, and feet 154, 156 engaging along top racks 162 in each receiver 158, 160, as feet 154, 156 are slid inwardly in slot-type receivers 158 and 160.

FIG. 6 illustrates the manner in which embodiment 140 is secured to an article 180. A hole or opening 182 is provided in article 180 for each leg 150, 152. Legs 150 and 152 are inserted through holes 182, such that feet 154 and 156 are on an opposite side of article 180 from the main portion of body 144. Feet 154 and 156 are slid into entrance openings 166 and 168 of receivers 158 and 160, respectively, ratcheting downwardly therein, drawing body 144 and base 146 closer to each other, until article 180 is pinched snugly between body 144 and base 146. Since receivers 158 and 160 angle inwardly in base 146, cord lock 142 can thereby be attached to articles 180 of different thickness, with legs 150 and 152 positioned at different locations along receivers 158 and 160, dependent upon the thickness of article 180. When engaged with racks 162 and 164, legs 150 and 152 establish fixed, spaced distances between body 144 and base 146, with the distance being dependent upon the position of legs 150 and 152 in receivers 158 and 160. Base 146 includes a slot 165 such that the cord (not shown) can be passed through aperture 148 and slot 165 regardless of the lug location on the racks.

Similarly, attachment structure 12 can accommodate connection to articles of different thickness by inserting legs 44, 46, 48 and 50 appropriate depths into receivers 54, 56, 58 and 60 until the article on which it is mounted is pinched firmly between body 40 and base 42. Attachment of second embodiment attachment structure 90 is achieved similarly to third embodiment 140, with legs 92, 94, 96 received at various locations along receivers 102, 104, 106 to accommodate articles of different thickness pinched between body 98 and base 108. In each embodiment, a fixed distance is established between the body and the base, with the distance being dependent upon the position of the legs within the receivers.

The present invention provides a mounting structure for buckles, cord locks and the like, which can be secured to articles of different thickness and which can be attached quickly, without the need for tools, adhesives or the like. Initial assembly is thereby facilitated, and replacement is simplified.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. An adjustable attachment structure, comprising:

a body having an opening adapted to releasably receive an attachment member;

a base adapted for attachment to an article;

one of said body and said base having a plurality of legs projecting outwardly therefrom;

the other of said body and said base having receivers for accepting at least a portion of each said leg;

a first connector part associated with said plurality of legs;

a second connector part associated with said receivers; and said first and second connector parts adapted for cooperative association to connect to each other and fix a spaced relation between said body and said base at a plurality of locations establishing different distances between said body and said base, the article being captured between said body and said base, wherein the attachment member can be released from said body while said base and said body are attached to the article.

2. The attachment structure of claim 1, said first and second connecter parts including a rack and a lug selectively engaging said rack.

3. The attachment structure of claim 2, said legs comprising said racks.

4. The attachment structure of claim 2, said legs disposed on said base and said body including the receivers having lugs.

5. The attachment structure of claim 2, said receivers each including the racks, and said legs having the lugs engaging said racks.

6. The attachment structure of claim 1, said base having said legs extending outwardly therefrom, each said leg having a rack along a length thereof, and said body including the receivers for each said leg, said receivers each having a lug for engaging the rack of a leg disposed in said receiver.

7. The attachment structure of claim 6, said base including three said legs.

8. The attachment structure of claim 1, said legs connected to said body.

9. The attachment structure of claim 8, racks defined by said receivers and said receivers disposed in said base, each said receiver having an entrance thereto on a same side of said base.

10. The attachment structure of claim 9, each said rack formed as a slot in said base angling inwardly from said same side of said base.

11. The attachment structure of claim 10, each said leg having a foot at a distal end thereof.

12. The attachment structure of claim 10, said body having two said legs.

13. The attachment structure of claim 10, said body having three said legs.

14. An attachment structure comprising:

a body and a base;

one of said body and said base having a plurality of slots therein, each said slot having an entrance and each said slot defining a rack angling inwardly in said body or base from said entrance; and the other of said body and said base having legs extending outwardly therefrom, each said leg having a distal end and a foot at said distal end, each said foot designed to slide in one of said slots, with said legs configured to engage said racks at discrete locations along lengths thereof.

15. The attachment structure of claim 14, said body having three said legs.

16. The attachment structure of claim 14, said body having two said legs.

17. An attachment structure comprising:

a body and a base discrete from said body said body having an opening adapted to releasably receive an attachment member, said base being adapted for attachment to an article;

one of said body and said base having a plurality of legs extending outwardly therefrom;

the other of said body and said base having receivers each adapted and arranged for receiving one of said legs inserted therein;

one of said legs and said receivers defining racks along lengths thereof; and the other of said legs and said receivers defining lugs for engaging said rack;

wherein the article is captured between said body and said base, and the attachment member can be released from said body while said base and said body are attached to the article.

18. The attachment structure of claim 17, said racks defined by said legs.

19. The attachment structure of claim 17, said racks defined by said receivers.

20. The attachment structure of claim 19, said base being plate-like, and said receivers each having an entrance on a same side of said base and angling inwardly from the entrance thereof.

21. An adjustable attachment structure, comprising:

a body;

a base;

said base having at least three legs projecting outwardly therefrom, each said leg having a rack along a length thereof;

said body having a receiver for each leg, each receiver accepting at least a portion of each said leg, said receivers each having a lug for engaging the rack of the leg disposed in said receiver; and said legs and said receivers adapted for cooperative association to connect to each other and fix a spaced relation between said body and said base at a plurality of locations establishing different distances between said body and said base.

22. An adjustable attachment structure, comprising:

a body;

a base;

said body having a plurality of legs projecting outwardly therefrom;

said base having receivers, each said receiver having an entrance thereto on a same side of said base, each said receiver defining a rack formed as a slot in said base angling inwardly from said same side of said base; and said legs and said receivers adapted for cooperative association to connect to each other and fix a spaced relation between said body and said base at a plurality of locations establishing different distances between said body and said base.

23. The attachment structure of claim 22, each said leg having a foot at a distal end thereof.

24. The attachment structure of claim 22, said body having two said legs.

25. The attachment structure of claim 22, said body having three said legs.

26. An adjustable attachment structure, comprising:

a body;

a base having a toothed leaf-spring connector portion;

one of said body and said base having a plurality of legs projecting outwardly therefrom;

the other of said body and said base having receivers for accepting at least a portion of each said leg;

a first connector part associated with said plurality of legs;

a second connector part associated with said receivers; and said first and second connector parts adapted for cooperative association to connect to each other and fix a spaced relation between said body and said base at a plurality of locations establishing different distances between said body and said base.

* * * * *

US006622355C1

(12) INTER PARTES REEXAMINATION CERTIFICATE (0145th)

United States Patent

Buscart et al.

(10) Number: US 6,622,355 C1

(45) Certificate Issued: Feb. 16, 2010

(54) MOUNTING STRUCTURE

(75) Inventors: Jordi Badrenas Buscart, Barcelona (ES); John S. Pontaoe, Chicago, IL (US)

(73) Assignee: Illinois Tool Works Inc., Glenview, IL (US)

Reexamination Request:
No. 95/000,125, Jan. 25, 2006

Reexamination Certificate for:

| | |
|---|---|
| Patent No.: | **6,622,355** |
| Issued: | **Sep. 23, 2003** |
| Appl. No.: | **10/310,270** |
| Filed: | **Dec. 5, 2002** |

Related U.S. Application Data

(60) Provisional application No. 60/345,693, filed on Jan. 3, 2002.

(51) Int. Cl.
*A44B 21/00* (2006.01)

(52) U.S. Cl. ..... 24/615; 24/271; 24/272

(58) Field of Classification Search ..... None
See application file for complete search history.

(56) References Cited

U.S. PATENT DOCUMENTS

| | | | |
|---|---|---|---|
| 3,120,971 | A | 2/1964 | Bengtsson |
| 3,235,297 | A | 2/1966 | Femberg |
| 4,202,087 | A | 5/1980 | Wilderman |
| 4,622,723 | A | 11/1986 | Krauss |
| 4,774,744 | A | 10/1988 | Kasai |
| 4,811,466 | A | 3/1989 | Zubli |
| 5,546,637 | A | 8/1996 | Niedecker |
| 5,974,637 | A | 11/1999 | Tracy et al. |
| 6,126,122 | A | 10/2000 | Ismert |
| 6,446,915 | B1 | 9/2002 | Ismert |
| 6,463,631 | B2 | 10/2002 | Noda |

FOREIGN PATENT DOCUMENTS

| | | |
|---|---|---|
| DE | 1191179 | 4/1965 |
| EP | 0245877 | 11/1987 |
| EP | 00190029 | 4/1990 |
| EP | 0 190 029 B1 | 4/1990 |
| EP | 0719958 | 9/1996 |
| EP | 1325690 | 7/2003 |
| EP | 1326031 | 7/2003 |
| GB | 2154647 | 9/1985 |
| GB | 2154647 A | 9/1985 |
| JP | 784022 | 3/1990 |
| JP | 10257907 | 9/1998 |

OTHER PUBLICATIONS

European Search Report, EP 1325690A3, Nov. 17, 2004.
Office action correspondence to European Patent Application Serial No. 02 029 017.7–2314, dated Nov. 24, 2008, 4 pages.

*Primary Examiner*—Joseph A. Kaufman

(57) ABSTRACT

A mounting structure for buckles, cord locks and the like is provided with a base and a body for placement on opposite sides of the article to which the component is to be secured. A first connector part in the nature of a rack is provided on one of the body and base, and a lug is provided on the other of the body and the base for engagement at various locations along the rack to secure the body and base on opposite sides of the article.

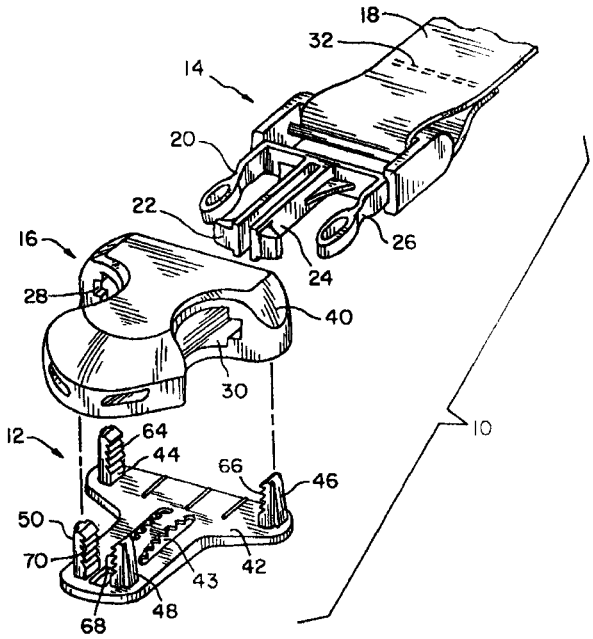

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 8 is cancelled.

Claims 1, 2, 4, 6, 7, 9–14, 17, 20–22 and 26 are determined to be patentable as amended.

Claims 3, 5, 15, 16, 18, 19 and 23–25, dependent on an amended claim, are determined to be patentable.

New claims 27–53 are added and determined to be patentable.

1. An adjustable attachment structure, comprising:

a body having an opening adapted to releasably receive an attachment member;

a base adapted for attachment to an article;

[one of said body and] said base having a plurality of legs projecting outwardly therefrom;

[the other of] said body [and said base] having receivers for accepting at least a portion of each said leg;

a first connector part associated with said plurality of legs;

a second connector part associated with said receivers; and said first and second connector parts adapted for cooperative association to connect to each other and fix a spaced relation between said body and said base at a plurality of locations establishing different distances between said body and said base, the article being captured between said body and said base, wherein the attachment member can be released from said body while said base and said body are attached to the article.

2. The attachment structure of claim 1, said first and second [connecter] *connector* parts including a rack and a lug selectively engaging said rack.

4. The attachment structure of claim 2, said [legs disposed on said base and said body including the] receivers having *said* lugs.

6. The attachment structure of claim 1, said base having said legs extending outwardly therefrom, each said leg having a rack along a length thereof, and said body including the receivers for each said leg, *each* said [receivers each] *receiver* having a lug for engaging the rack of a leg disposed in said receiver.

7. [The attachment structure of claim 6, said base including three said legs] *An adjustable attachment structure, comprising: a body having an opening adapted to releasably receive an attachment member; a base adapted for attachment to an article; said base comprising at least three legs extending outwardly therefrom, each said leg having a rack along a length thereof; said body having receivers for accepting at least a portion of each said leg, each said receiver having a lug for engaging the rack of a leg disposed in said receiver; a first connector part associated with said plurality of legs; a second connector part associated with said receivers; and said first and second connector parts adapted for cooperative association to connect to each other and fix a spaced relation between said body and said base at a plurality of locations establishing different distances between said body and said base, the article being captured between said body and said base, wherein the attachment member can be released from said body while said base and said body are attached to the article.*

9. The attachment structure of claim [8] *1*, racks defined by said receivers and said receivers disposed in said [base] *body*, each said receiver having an entrance thereto on a same side of said [base] *body*.

10. The attachment structure of claim 9, each said rack formed as a slot in said [base] *body* angling inwardly from said same side of said [base] *body*.

11. The attachment structure of claim [10] *1*, each said leg having a foot at a distal end thereof.

12. The attachment structure of claim [10] *1*, said [body] *base* having two said legs.

13. [The attachment structure of claim 10, said body having three said legs] *An adjustable attachment structure, comprising: a body having an opening adapted to releasably receive an attachment member; a base adapted for attachment to an article; said base having three legs projecting outwardly therefrom; said body having receivers for accepting at least a portion of each said leg; a first connector part associated with said plurality of legs; a second connector part associated with said receivers; and said first and second connector parts adapted for cooperative association to connect to each other and fix a spaced relation between said body and said base at a plurality of locations establishing different distances between said body and said base, the article being captured between said body and said base, wherein the attachment member can be released from said body while said base and said body are attached to the article.*

14. An attachment structure comprising:

a body and a base;

one of said body and said base having a plurality of slots therein, each said slot having an entrance and each said slot defining a *first rack formed in an undercut wall of said slot and* rack angling inwardly in said body or base from said entrance*, and at least one said slot defining a second rack*; and the other of said body and said base having legs extending outwardly therefrom, each said leg having a distal end and a foot at said end, each said foot designed to slide in one of said slots, with said legs configured to engage said *first* racks at discrete locations along lengths thereof*, and at least one said leg configured to engage said second rack at discrete locations along lengths thereof.*

17. An attachment structure comprising:

a body and a base discrete from said body , said body having an opening adapted to releasably receive an attachment member, said base being adapted for attachment to an article;

[one of said body and] said base having a plurality of legs extending outwardly therefrom;

[the other of] said body [and said base] having receivers each adapted and arranged for receiving one of said legs inserted therein;

one of said legs and said receivers defining racks along lengths thereof; and the other of said legs and said receivers defining lugs for engaging said rack;

wherein the article is captured between said body and said base, and the attachment member can be released from said body while base and said body are attached to the article.

20. The attachment structure of claim 19, said base being plate-like[, and said receivers each having an entrance on a same side of said base and angling inwardly from the entrance thereof].

21. An adjustable attachment structure, comprising:

a body;

a base;

said base having at least three legs projecting outwardly therefrom, each said leg having a rack along a length thereof;

said body having *an opening adapted to releasably receive a male component of a buckle,* a receiver for each leg, each receiver accepting at least a portion of each said leg, said receivers each having a lug for engaging the rack of the leg disposed in said receiver; and said legs and said receivers adapted for cooperative association to connect to each other and fix a spaced relation between said body and said base at a plurality of locations establishing different distances between said body and said base.

22. An adjustable attachment structure, comprising:

a body;

a base;

said body having a plurality of legs projecting outwardly therefrom;

said base having receivers, each said receiver having an entrance thereto on a same side of said base, each said receiver defining a *first* rack formed as a slot in said base angling inwardly from said same side of said base; *at least one said receiver defining a second rack running along its said slot;* and said legs and said receivers adapted for cooperative association to connect to each other and fix a spaced relation between said body and said base at a plurality of locations establishing different distances between said body and said base.

26. An adjustable attachment structure, comprising:

a body;

a base having a toothed leaf-spring connector portion *positioned to bear on a mating article captured between said body and said base when said legs are advanced into said receivers*;

one of said body and said base having a plurality of legs projecting outwardly therefrom;

the other of said body and said base having receivers for accepting at least a portion of each said leg;

a first connector part associated with said plurality of legs;

a second connector part associated with said receivers; and said first and second connector parts adapted for cooperative association to connect to each other and fix a spaced relation between said body and said base at a plurality of locations establishing different distances between said body and said base.

*27. The attachment structure of claim 1, wherein said body further comprises a top and a bottom and at least one of said receivers comprises an aperture extending into the bottom of said body but not intersecting the top of said body.*

*28. An adjustable attachment structure, comprising: a body comprising a top and a bottom, a shell having a peripheral edge and a central portion projecting up from said peripheral edge, said shell having a generally convex outer surface, defining the top of said body, and an inner surface; said body having an opening adapted to releasably receive an attachment member; a base adapted for attachment to an article; said base having a plurality of legs projecting outwardly therefrom; said body having receivers for accepting at least a portion of each said leg, wherein at least one of said receivers comprises an aperture extending into the bottom of said body but not intersecting the top of said body; a first connector part associated with said plurality of legs; a second connector part associated with said receivers; and said first and second connector parts adapted for cooperative association to connect to each other and fix a spaced relation between said body and said base at a plurality of locations establishing different distances between said body and said base, the article being captured between said body and said base, wherein the attachment member can be released from said body while said base and said body are attached to the article.*

*29. The attachment structure of claim 28, wherein said shell further comprises a bottom plate.*

*30. The attachment structure of claim 29, wherein said aperture extends into said bottom plate.*

*31. The attachment structure of claim 30, wherein said aperture extends through said bottom plate.*

*32. The attachment structure of claim 1, wherein said base is plate-like and has an upper surface and a lower surface.*

*33. The attachment structure of claim 32, wherein said plurality of legs projects from said upper surface.*

*34. The attachment structure of claim 32, wherein said upper surface has a fabric-engaging surface adapted to prevent sliding movement of said upper surface relative to a fabric when the upper surface is mounted against a fabric.*

*35. The attachment structure of claim 32, wherein said lower surface is generally flat.*

*36. The attachment structure of claim 1, one of said first and second connector parts comprising a rack and the other of said first and second connector parts comprising a lug adapted to engage said rack.*

*37. The attachment structure of claim 36, said first connector part comprising said rack.*

*38. The attachment structure of claim 36, said second connector part comprising said lug.*

*39. The attachment structure of claim 36, said first connector part comprising said lug.*

*40. The attachment structure of claim 36, said second connector part comprising said rack.*

*41. The attachment structure of claim 1, each said leg having a foot at a distal end thereof.*

*42. An adjustable attachment structure, comprising: a body having an opening adapted to releasably receive an attachment member; a base adapted for attachment to an article; said base having four legs projecting outwardly therefrom; said body having receivers for accepting at least a portion of each said leg; a first connector part associated with said plurality of legs; a second connector part associated with said receivers; and said first and second connector parts adapted for cooperative association to connect to each other and fix a spaced relation between said body and said base at a plurality of locations establishing different distances between said body and said base, the article being captured between said body and said base, wherein the attachment member can be released from said body while said base and said body are attached to the article.*

*43. The attachment structure of claim 14, wherein said second rack is formed in each said slot.*

*44. The attachment structure of claim 14, wherein said second rack angles inwardly into said body or base from said entrance.*

*45. The attachment structure of claim 14, wherein said second rack is disposed on one side of at least one said slot and said first rack of the corresponding slot is disposed on the other side of the corresponding slot.*

*46. The attachment structure of claim 14, wherein said second rack is formed in a side wall of at least one said slot.*

*47. The attachment structure of claim 46, wherein said first and second racks are disposed on opposite sides of at least one said slot.*

*48. The attachment structure of claim 47, wherein said second rack extends substantially parallel to at least one said slot.*

*49. The adjustable attachment structure of claim 26, said base having a plurality of legs projecting outwardly therefrom; said body having receivers for accepting at least a portion of each said leg.*

*50. The adjustable attachment structure of claim 1, further comprising an attachment member, wherein the body opening is adapted to releasably receive the attachment member.*

*51. The adjustable attachment structure of claim 50, wherein the attachment member can be released from said body while said base and said body are attached to the article.*

*52. The adjustable attachment structure of claim 17, said base having three said legs.*

*53. The attachment structure of claim 17, wherein said body further comprises a top and a bottom and defines a shell having a peripheral edge and a central portion projecting up from said peripheral edge, said shell having a generally convex outer surface, defining the top of said body, and an inner surface, and at least one of said receivers comprises an aperture extending into the bottom of said body but not intersecting the top of said body.*

* * * * *